United States Patent [19]

Teranishi et al.

[11] Patent Number: 4,682,681

[45] Date of Patent: Jul. 28, 1987

[54] ESCALATOR

[75] Inventors: Katsuya Teranishi, Katsuta; Kazuhira Ozima, Kasama; Cyuichi Saito, Katsuta; Hiroyasu Ogawa, Hitachi, all of Japan

[73] Assignee: Hitachi, Ltd., Tokyo, Japan

[21] Appl. No.: 843,619

[22] Filed: Mar. 25, 1986

[30] Foreign Application Priority Data

| | | | |
|---|---|---|---|
| Mar. 27, 1985 | [JP] | Japan | 60-60790 |
| Mar. 28, 1985 | [JP] | Japan | 60-61987 |
| Jun. 12, 1985 | [JP] | Japan | 60-126108 |
| Jun. 28, 1985 | [JP] | Japan | 60-140350 |

[51] Int. Cl.[4] ..... B66B 23/12

[52] U.S. Cl. ..... 198/333; 198/324

[58] Field of Search ..... 198/321, 322, 324, 326, 198/333; 104/25

[56] References Cited

U.S. PATENT DOCUMENTS

| | | | |
|---|---|---|---|
| 4,557,369 | 12/1985 | Ishida et al. | 198/333 |
| 4,569,433 | 2/1986 | Ishida et al. | 198/333 |

FOREIGN PATENT DOCUMENTS

| | | | |
|---|---|---|---|
| 3046203 | 7/1982 | Fed. Rep. of Germany | 198/321 |
| 56-41555 | 9/1981 | Japan . | |
| 59-12067 | 1/1984 | Japan . | |
| 59-203085 | 11/1984 | Japan . | |

*Primary Examiner*—Joseph E. Valenza
*Assistant Examiner*—Jonathan D. Holmes
*Attorney, Agent, or Firm*—Antonelli, Terry & Wands

[57] ABSTRACT

In an escalator, at least one of a plurality of staircase steps connected in an endless manner and supported by a body frame is made for a wheel chair loading staircase step. The staircase step comprises an upwardly movable main tread board, a sub-tread board supported by the main tread board, a lifting mechanism for lifting the main tread board, an electric drive unit for driving the lifting mechanism and a widening mechanism for automatically widening the sub-tread board by means of the electric drive unit.

7 Claims, 12 Drawing Figures

ESCALATOR

BACKGROUND OF THE INVENTION

The present invention relates to an escalator which may be used not only by a general healthy pedestrian but also a person who must use a wheel chair. More particularly, the invention is concerned with an escalator staircase structure which is safe in moving a wheel chair up and down.

An escalator has been widely used as a serviceable equipment for general healthy pedestrians or walkers. Recently, various escalators have been used also in various public facilities such as a city traffic system. Accordingly, there is a strong demand such that the escalators be serviceable not only for general pedestrian but also physically handicapped people who must use wheel chairs.

However, the thus far proposed general escalators have been made only in consideration of the general healthy pedestrians as described above. For this reason, a fore and back length or a longitudinal length of tread boards of the escalator is kept at about 400 mm. This dimension is sufficient for the healthy pedestrians but, in the case where the people using their wheel chairs rides on the escalator, that dimension is too small in comparison with a size of the wheel chair so that there is a great fear that they would fall down with great danger. Therefore, it is generally understood that it is impossible to make the escalators serviceable for the wheel chair users.

Nevertheless, in view of recent stronger public opinion and spread of behavior area of the wheel chair users, a serviceable application of the escalators to the wheel chair users becomes a serious task to be solved. Thus, various attempts have been made to deal with this problem.

For example, Japanese Patent Publication No. 41555/81 discloses an escalator in which a special tread board having a larger fore and back dimension is provided among staircase steps of the escalator. Also, Japanese Patent Laid-open No. 12067/84 discloses an escalator which has a mechanism for widening, as desired, the fore and back dimension of the tread board among the staircase steps. Also, Japanese Patent Laid-open No. 203085/84 discloses a mechanism for elevating a specific tread board using an electric power as desired, so that the specific board may be kept at the same level as that of a tread board of the adjacent fore or rear staircase step, thereby widening the effective area of the tread surface. However, any of the escalators according to these techniques must involve a complicated structure. Furthermore, the escalators according to these techniques are serviceable to some extent but is not satisfactory in safety aspect.

SUMMARY OF THE INVENTION

Accordingly, an object of the present invention is to provide an escalator which is capable of ensuring a sufficient space for loading a wheel chair and is simple to operate.

In an escalator according to the present invention, at least one of a plurality of staircase steps connected in an endless manner and supported by a body frame is made for a wheel chair loading staircase step, the wheel chair loading staircase step comprising a main tread board movable upwardly, a sub-tread board mounted on the main tread board, means for lifting the main tread board, electrical drive means for driving the lifting means, and means for automatically widening the sub-tread board in accordance with the lifting movement when the lifting means is driven by the drive means to raise the main tread board.

Japanese Patent Application No. 70900/84 related to a technology for raising and widening a tread board of a specific staircase step was filed on Apr. 11, 1984 in Japan prior to the application date of the Japanese application upon which the present application was based. However, the present invention is related to a further improvement of that technology.

BRIEF DESCRIPTION OF THE DRAWINGS

The present invention will be described with reference to the accompanying drawings in which.

DETAILED DESCRIPTION OF THE PREFERRED EMBODIMENTS

Figure 1:
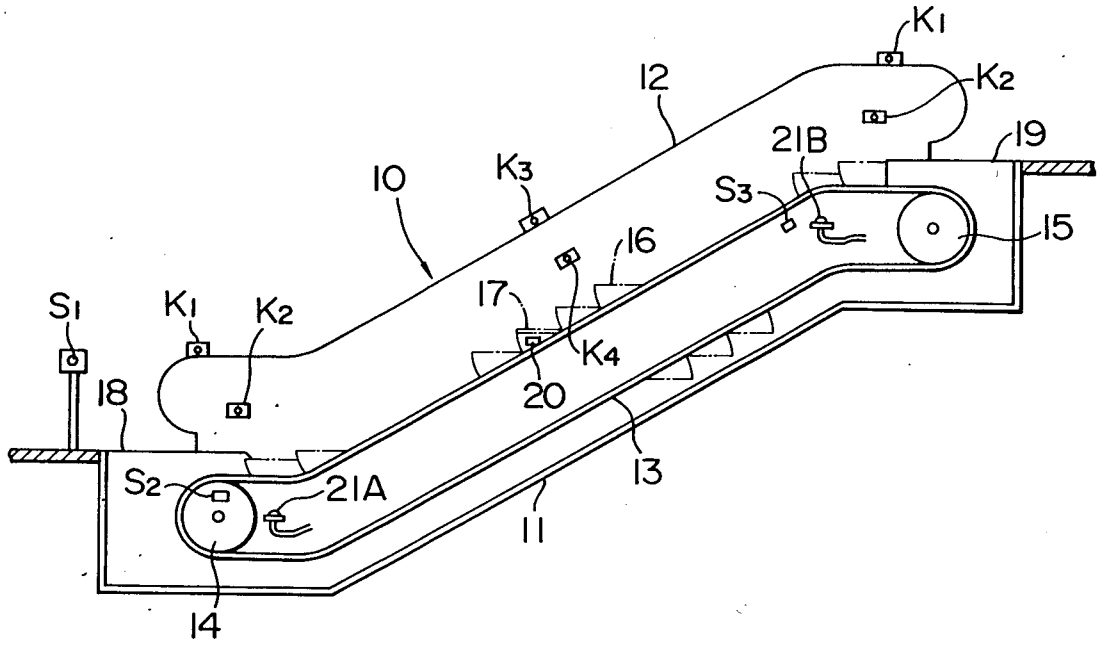
FIG. 1 is a side elevational view of an escalator as a whole according to the present invention.

A preferred embodiment of the present invention will be described with reference to FIGS. 1 to 5.

According to the present invention, an escalator, generally designated by reference numeral 10, has a body frame 11, and a plurality of staircase steps 16 which are connected in an endless manner by means of a chain 13 entrained between sprockets 14 and 15 and supported by the body frame 11. At least one (for example, designated by reference numeral 17) of the staircase steps 16 is made for a wheel chair loading staircase step. The wheel chair loading staircase step 17 is provided with a tread lifting and widening mechanism 30 to be described later in detail.

Reference character $S_1$ designates a stop switch exclusively for the wheel chair user. In the case where the wheel chair user would like to ride on the escalator together with his wheel chair, depression of the switch $S_1$ suffices. Reference character $K_1$ denotes an actuator switch speciallized for the wheel chair user for actuating the escalator after the wheel chair has been loaded on the escalator. Reference characters $S_2$ and $S_3$ denote stop switches for stopping the wheel chair loading staircase 17 at constant positions at an entrance portion 18 and an exit portion 19, respectively. Electric power signal supply devices 21A and 21B for supplying electric power to electric power signal receiving devices to be described later are adapted to come into contact with the electric power signal receiving devices only at predetermined positions of the entrance portion 18 and the exit portion 19.

The specific staircase step 17 will be explained in greater detail with reference to FIGS. 2 and 3.

Figure 2:
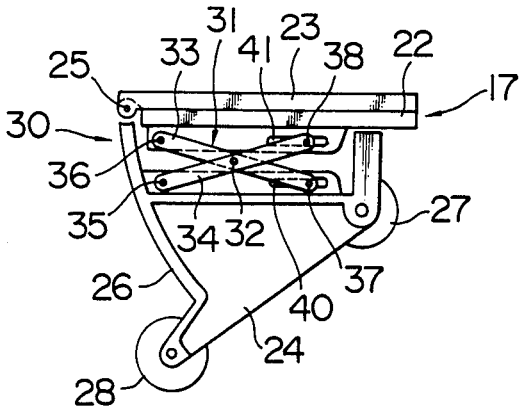
FIG. 2 is a side elevational view showing a tread board lifting mechanism for a wheel chair loading staircase step according to the present invention.
Figure 3:
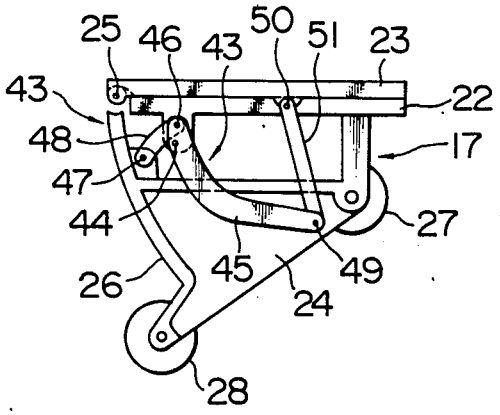
FIG. 3 is a detailed side elevational view showing a tread board widening mechanism for the specific step.

In FIGS. 2 and 3, two tread boards 22 and 23 are folded together. In normal operation, main tread boards 22 and sub-tread board 23 are collapsed and folded together, as shown in FIGS. 2 and 3, so that the two boards are located at a lower position where the boards are held in contact with top portions of a pair of frame members 24. When the tread boards are raised and opened as described later, the tread board 23 is rotated about a shaft 25 to be reversed while the tread boards 22 and 23 are being raised apart from the frame members 24. Each of the frame members 24 carries the tread boards 22 and 23, a riser 26, a front wheel 27 and a rear wheel 28 described later.

Figure 5:
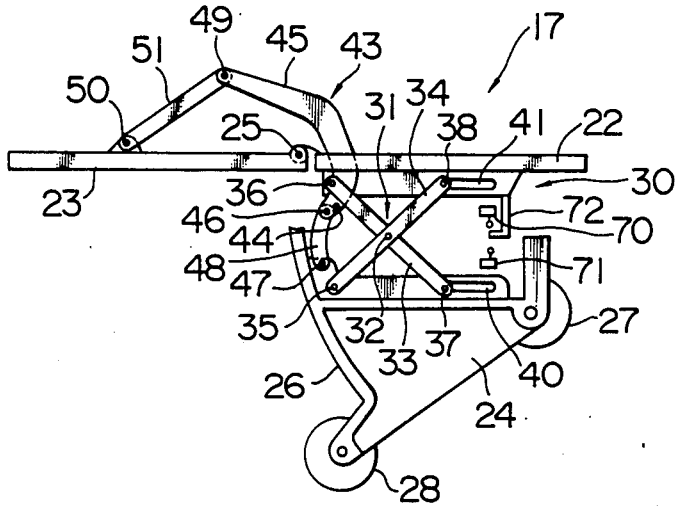
FIG. 5 is a side elevational view showing a state in which the tread board of the staircase step has been raised and widened.

Referring to FIGS. 2 and 5, the tread board lifting and widening mechanism 30 will be described in detail.

The tread board lifting and widening mechanism 30 has a cross link mechanism 31, for lifting the tread boards 22 and 23, which includes two levers 33 and 34 connected at mid portions to each other to be rotatable about a pin 32. Respective left ends of the levers 33 and 34 are rotatably engaged with the top portion of the frame member 24 and a lower portion of the tread board 22, respectively, whereas the respective right ends are engaged rotatably about pins 37 and 38 and movably in a horizontal direction within elongated holes 40 and 41 formed in the upper portion of the frame member 24 and the lower portion of the tread board 22, respectively. Also, at the right end of the lever 33 is provided a take-up nut 65 which will be described later.

Referring to FIG. 3, an explanation will be made as to a link-type widening mechanism 43 for widening or opening the tread surface by automatically reversing the sub-tread board 23 as the main tread board 22 is raised.

The widening mechanism 43 is composed of an arm 45 rotatably supported at a lower portion of the tread board 22 by a pin 44, a lever 48 which is rotatably connected at one end to one end of the arm 45 by a pin 46 and rotatably supported at the other end to an upper portion of the frame member 24 by a pin 47, and a lever 51 which in turn is connected at one end to the other end of the arm 45 by a pin 49 and rotatably supported at the other end to a lower portion 23 by a pin 50.

Figure 4:
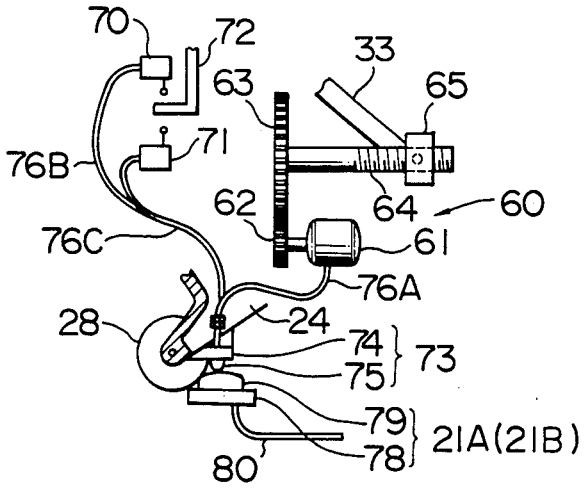
FIG. 4 is a detailed side elevational view showing a drive mechanism of the staircase and a contact portion.

Referring now to FIG. 4, an electric drive device, generally designated by reference numeral 60, for driving the tread board lifting and widening mechanism 30 will be described.

Reference numeral 61 denotes a motor provided within the frame members 24. A gear 62 is mounted on an output shaft of the motor 61. A gear 63 engaged with the gear 62 causes a take-up rod 64 to be drivingly rotated, so that the take-up nut 65 that is threadedly engaged with a threaded portion of the take-up rod 64 may be moved right and left.

Reference numeral 70 denotes a switch which is adapted to detect a state in which the tread board 22 has been raised and the tread board 23 has been reversed (that is, the state where the tread surface is raised and widened). A switch 71 is adapted to detect the state where the tread boards 22 and 23 are held in the position shown in FIGS. 2 and 3 (that is, the normal state). These switches 70 and 71 are actuated by a switch actuating dog 72. A staircase step side electric power receiving device 73 composed of a plurality of contacts 75 implanted in an insulation support plate 74 is provided at a lower end of the frame member 24. The motor 61 and the respective switches 70 and 71 are electrically connected to the respective contacts 75 through lead wires 76A, 76B and 76C. Also, the above-described electric power supply devices 21A and 21B each have a plurality of contacts 79 on a insulation plate 78 in opposition to the contacts 75 so that the contacts 79 may come into sliding contact with the contacts 75 of the staircase step side electric power receiving device 73. The respective contacts 79 are electrically connected through a lead wire 80 to an outside electric source circuit (not shown) and a control circuit (not shown). Therefore, the electric power supply device 21A or 21B provided on the body side is engaged with the electric power receiving device 73 so that the respective contacts 79 and 75 are brought into contact with each other, thereby performing the switching-over operation of the electric power source and control signal to the motor 61.

The operation of the thus constructed staircase step 17 specialized for use with the wheel chair will be described.

When the special stop switch $S_1$ is depressed, an instruction signal from the switch $S_1$ causes the special staircase step 17 to actuate the switch $S_2$ and to stop at the entrance 18. In this position, the staircase side electric power receiving device 73 and the body side electric power supply device 21A are engaged with each other, so that the respective contacts 75 and 79 are brought into contact with each other to supply an electric power to the motor 61, thereby starting the motor 61. The drive of the motor 61 causes the right end of the lever 33 of the cross link mechanism 31 to move leftward through the gears 62, 63, the take-up rod 64, and the take-up nut 65. As shown in FIG. 5, the cross link mechanism 31 causes the tread board 22 to rise. In the meantime, the upward movement of the tread board 22 causes the sub-tread board 23 to be reversed to provide a wide effective tread surface. In this state, the switch 70 is actuated by the switch actuating dog 72 to thereby interrupt the power supply to the motor 61 to stop the rotation of the latter. After the upward movement and opening operation of the tread surface have thus been completed, the wheel chair can be loaded on the tread surface with the rear wheels thereof being located on the sub-tread board 23 and the front wheels thereof being located on the main tread board 22. At this time, since the tread boards 22 and 23 have been raised, there is no fear that the foot rest of the wheel chair loaded on the tread boards 22 and 23 would interfere with the adjacent upper staircase.

After completion of the correct loading of the wheel chair, when the special actuating switch $K_2$ is depressed, the escalator 10 starts its driving operation. It is preferable that a speed of the escalator at this time be at 10 m/min which is slower than a normal operational speed of 30 m/min. When the special staircase step reaches the vicinity of the upper exit portion 19 and the stop switch $S_3$ is actuated, the special staircase step 17 stops at the exit portion 19. In this position, the staircase side electric power receiving device 73 and the body side electric power supply device 21B are engaged with each other. When the wheel chair is taken away from the staircase step 17 and an instruction for the normal operation is outputted, the motor 61 is rotated in the reverse direction to the forward rotational direction to return the tread boards 22 and 23 back to the original position shown in FIGS. 2 and 3 and the motor 61 is stopped by the operation of the switch 71 by means of the switch actuating dog 72.

The foregoing description is related to the upward movement of the escalator. In case of the downward movement, it is sufficient to operate the system such that the tread surface of the special staircase step 17 is raised and widened at the upper entrance portion 19 and is returned back to the normal state at the lower exit 18.

The first embodiment of the present invention has been fully described above. In accordance with this embodiment, without a fear that, during the lifting and widening of the tread surface, the foot rest of the wheel chair would not interfere with the adjacent staircase step, it is possible to put the wheel chair on the escalator. Therefore, one staircase step structure per one wheel chair suffices. Furthermore, according to the first embodiment, since the lifting and widening of the tread surface may be automatically attained, any troublesome work would not be imposed on the wheel chair user or his supporter.

Incidentally, although, in the foregoing embodiment, the cross link mechanism is used for lifting the tread board 22, it is possible to raise the tread board 22 with any other suitable mechanism. Also, although the effective tread surface is widened by reversing the tread board 23, it is possible to slidingly move the tread board rearwardly. Also, the technique disclosed above in accordance with the present invention is applicable to use of a cart or any other loader.

Another embodiment of the present invention will now be described with reference to FIGS. 6 and 7 in which the same reference numerals are used to designate the like members or components in FIGS. 1 to 5.

Figure 6:
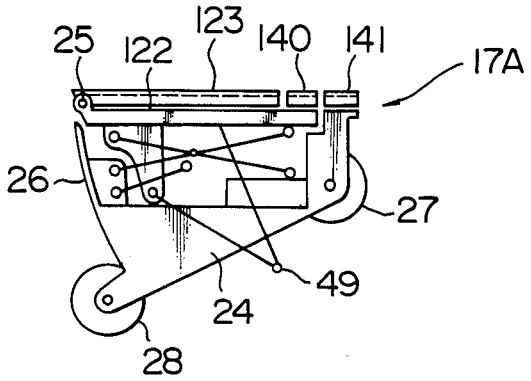
FIG. 6 is a side elevational view showing a normal state of the staircase step in accordance with another embodiment of the invention.
Figure 7:
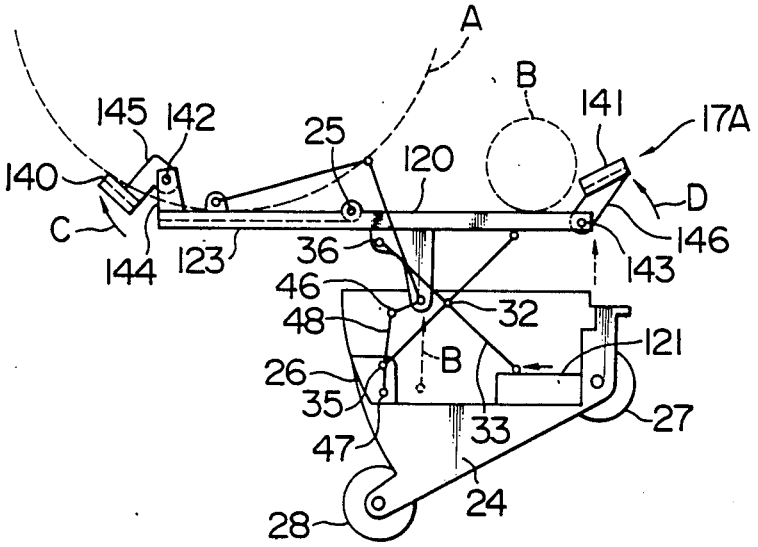
FIG. 7 is a side elevational view showing a state in which the specific staircase step shown in FIG. 6 has been widened.

As shown in FIGS. 6 and 7, in a staircase step 17A, a part of a sub-tread board 123 is divided and used as a wheel chair stopper tread board 140, whereas a part of a main tread board 122 is divided and used as another wheel chair stopper tread board 141. The wheel chair stopper tread board 140 is engaged with the sub-tread board 123 through a pivot pin 142 and brackets 144 and 145 whereas the wheel chair stopper tread board 141 is engaged with the main tread board 122 through a pivot pin 143 and a bracket 146. Reference numeral 121 denotes a guide surface instead of the elongated hole 40 shown in FIG. 5.

With such a structure, in the state in which the sub-tread board 123 is folded in alignment with the main tread board 122 as shown in FIG. 6, the tread boards 123, 140 and 141 are included in a single plane so that the appearance of this specific staircase step is substantially the same as that of other ordinary staircase steps. Thus, it is possible to carry out an operation service mainly for the ordinary pedestrians as in the conventional escalator.

Figure 8:
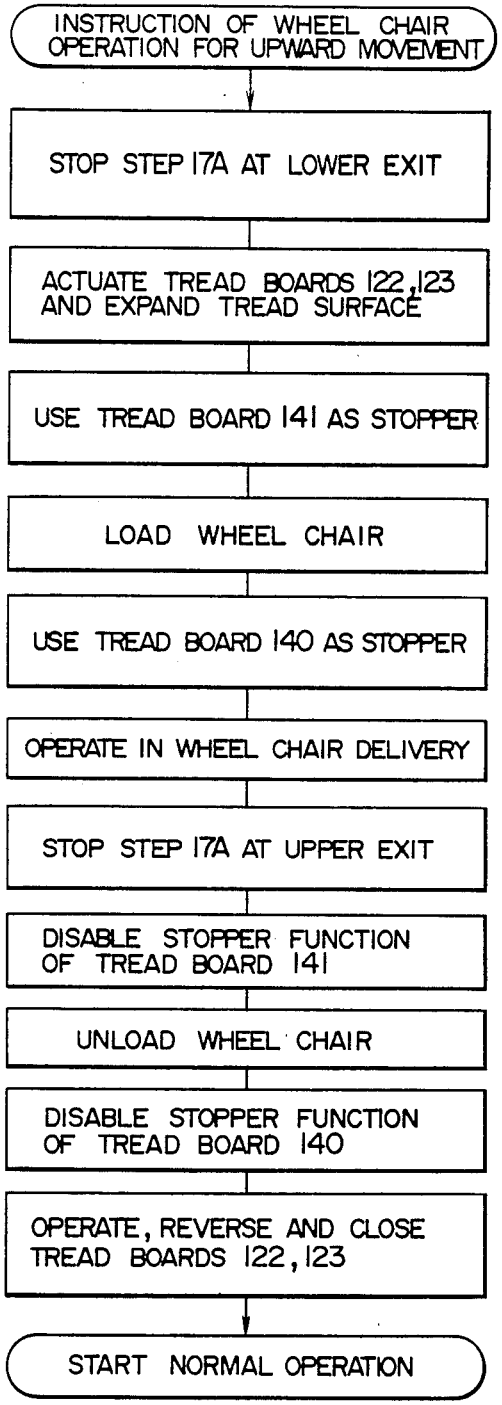
FIG. 8 is a flowchart for illustrating the upward operation of the staircase shown in FIGS. 6 and 7.
Figure 9:
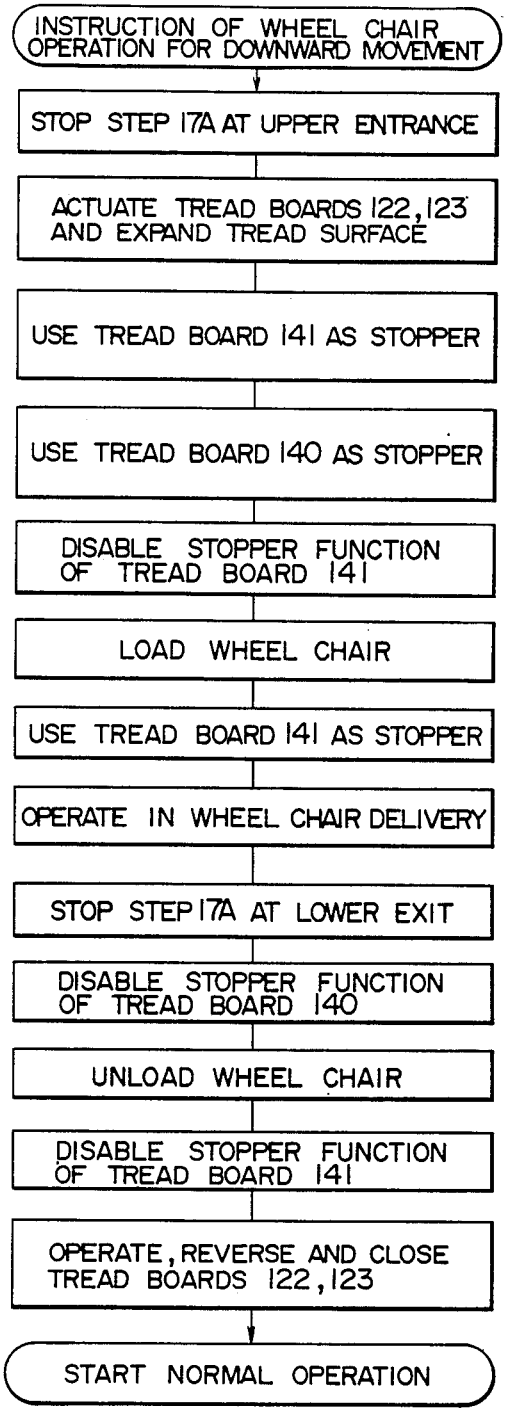
FIG. 9 is a flowchart for illustrating the downward operation of the staircase shown in FIGS. 6 and 7.

When a service for the wheel chair user is needed, the escalator is operated in accordance with operational orders as shown in FIGS. 8 and 9, to carry out the operation service for the wheel chair user.

The operational order will be described by way of example with reference to FIG. 8 which illustrates the upward operation. When a wheel chair operation instruction for the upward movement, a wheel chair staircase step 17A is stopped at the lower entrance. Then, the sub-tread board 123 is raised together with the main tread board 122 while the sub-tread board 123 is being developed, and the wheel chair stopper tread board 141 is rotated in the direction D indicated in FIG. 7, thereby attaining the wheel chair stopping function. Then, the wheel chair is loaded on the tread surface. Thereafter, the rear side wheel chair stopper tread board 140 is rotated in the direction C indicated in FIG. 7, thereby attaining the wheel chair stopping function. Thus, the above described tread boards 140 and 141 serve as the stoppers for the main wheels A and the front wheels B, respectively, so that the wheel chair may be positively held on the tread boards 122 and 123 even if a control means of the wheel chair would not be actuated. Under such a condition, the wheel chair is delivered up to the upper exit. When the wheel chair reaches the upper exit, the wheel chair stopping function of the wheel chair stopper tread board 141 is disabled, that is, the latter is rotated in the direction opposite to the direction D indicated in FIG. 7, so as to allow the wheel chair to be taken off to the outside of the escalator. Thereafter, the wheel chair stopping function of the wheel chair stopper tread board 140 is disabled in the same manner as in the tread board 141. Then, the tread boards 122 and 123 are folded together for the normal operation service.

On the other hand, FIG. 9 shows, by way of example, the operational order during the downward operation of the escalator. The difference from the upward operation shown in FIG. 8 is as follows. The wheel chair loading staircase step 17A is stopped at the upper entrance and the tread boards 122 and 123 are developed and extended. Thereafter, the tread board 140 serves as the wheel chair stopper, that is, the tread board 140 is rotated in the direction C in FIG. 7. Until the wheel chair may be loaded on the tread surface, the tread board 141 is rotated in the direction D in FIG. 7 (that is, in the same state as in the wheel stopping function during the upward movement), to thereby restrict the riding of the wheel chair. After the wheel chair stopping function of the tread board 140 has been performed, a temporary stopping function of the tread board 141 is disabled (the latter is rotated in the direction opposite to the direction D in FIG. 7) to allow the wheel chair to ride on the tread surface. Thereafter, again, the tread board 141 serves as the wheel chair stopper. Incidentally, the operational order at the lower exit is the same as that at the upper exit in the upward operation as shown in FIG. 9, except for the order of the tread boards 140 and 141.

Namely, the operations of the wheel chair tread boards 140 and 141 are such that, at the entrance, prior to the loading of the wheel chair, the wheel chair stopper tread board corresponding to a forward or leading one with respect to the operational direction of the escalator must be projected to attain its wheel chair stopping function while allowing the wheel chair to be loaded on the tread surface, and thereafter, the other wheel chair stopper tread board corresponding to a rearward or trailing one with respect to the operational direction is projected to receive the wheel chair on the staircase step for starting the delivery. On the other hand, at the exit, the wheel chair stopper tread board corresponding to the forward or leading one with respect to the operational direction is first disabled in its wheel chair stopping function and, then, the rearward or trailing side wheel chair stopper plate is received in its original position. Thus, it is possible to prevent the wheel chair from falling rearwardly at the exit.

The operations of the wheel chair stopper tread boards are carried out in the state in which the staircase step is stopped at the entrance/exit portion.

Figure 10:
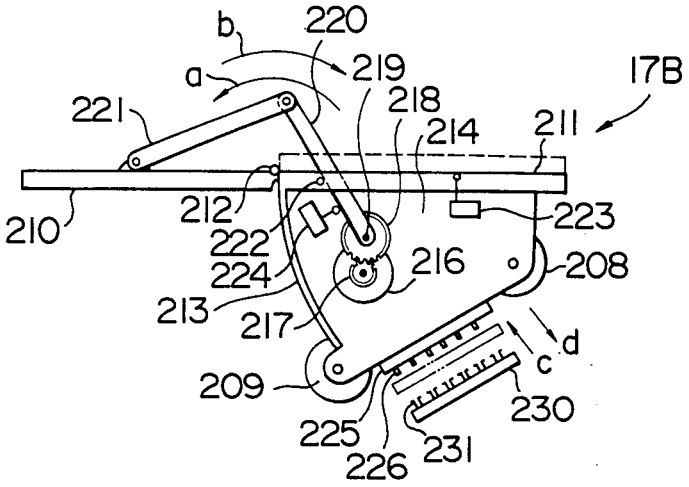
FIG. 10 is a side elevational view showing another embodiment of the invention.

Referring to FIG. 10, still another embodiment of the invention will now be described. In a specific staircase step 17B shown in FIG. 10, reference numerals 210 and 211 denotes foldable tread boards. In a normal state, the tread board 210 is overlaid on the tread board 211 as indicated by dotted lines. When the tread surface is extended as described later, the tread board 211 is turned about a shaft 212. Reference numeral 213 denotes a riser and 214 denotes a pair of (right and left) frame members which support the tread boards 210, 211, riser 213 and front and rear wheels 208 and 209. A gear 217 is mounted on an output shaft of a motor 216 disposed in the frame members 14. A gear 218 is engaged with the gear 217 to cause a shaft 219 to drivingly rotate, thereby turning, in a direction a, a link 220 fixed at one end to the shaft 219. To the other end of the link 220 is fixed one end of a link 221 which in turn is rotatably connected to an underside of the tread board 210. A support member 222 for the link 220 serves to support a weight load imposed on the tread board 210 through the link 221. A switch 223 is adapted to detect a normal state in which the tread board 210 is located in the position indicated by dotted lines, whereas another switch 224 is adapted to detect an expanded state in which the tread board 210 is located in the position indicated by solid lines. An electric power collecting means 225 is provided at a lower side of the frame members 214 and carries contacts 226 which serves to receive electric powers and signals upon the engagement with a movable electric power supply means 230 provided on a body side.

The operation of the system will be described with reference to FIGS. 1 and 10.

When the stop switch $S_1$ is depressed, an instruction signal fed out from the switch $S_1$ causes the specific staircase step 17B to actuate the stop switch $S_2$ and to stop at the entrance 18. Subsequently, the movable electric power supply means 230 on the body side is moved upwardly in a direction c (FIG. 10), so that the contacts 231 and 226 are engaged with each other to start the motor 216. The driving of the motor 216 causes the link 220 to turn through the gears 217, 218 and shaft 219 to thereby angularly move the tread board 210 to the position indicated by the solid lines. At this position, the switch 224 is actuated to stop the rotation of the motor 216. After the rotational operation of the tread board 210 has been completed, the wheel chair is allowed to enter the tread surface, with rear wheels of the wheel chair being located on the reversed tread board 210 and front wheels thereof being located on the tread board 211.

After the wheel chair has been loaded on the tread surface in a correct position, when the speciallized switch $K_2$ is actuated, the movable supply means 230 is moved downwardly in a direction d to separate the contacts 231 from the contacts 226. After a predetermined period of time lapses, the escalator is to operate. When the specified staircase step 17B reaches the vicinity of the upper exit to actuate the stop switch $S_3$, the specific staircase step 17B stops at the exit 19. In this position, the movable supply means 230 is actuated to engage with the electric power collecting means 225. When the wheel chair is unloaded from the staircase step 17B and an instruction signal for a normal operation is outputted, the motor 216 is actuated to return the tread board 210 back to the position shown by dotted lines, so that the motor 216 is stopped by the action of the switch 223. Subsequently, the movable supply means 230 is separated from the collecting means 225. Thus, the normal operation is possible.

Although the foregoing description is related to the upward operation, in case of the downward operation, it is sufficient that the tread surface of the specified staircase step is expanded at the upper entrance and is returned back to the normal state at the lower exit.

Still another embodiment of the invention will be described with reference to FIG. 11 which shows a special staircase step 17C located at an entrance 18. In the interior of the special step 17C, there is provided a tread surface widening mechanism 330. The staircase step is constructed so that a retraction force in a direction D exerted by a motor 361 is used to expand the tread surface in a direction E by a link mechanism 331. The tread surface widening mechanism 330 of the staircase step 17C has an electric power receiving means 373 electrically connected to the motor 361 through a lead line 376. The receiving means 373 is fixed to a lower end of the staircase step 17C. On the other hand, in a stationary member of the escalator, electric power supply means 321 spaced a distance m away from the receiving means 373 are provided at the stop positions of the special step 17C at the entrance and exit, respectively.

Figure 11:
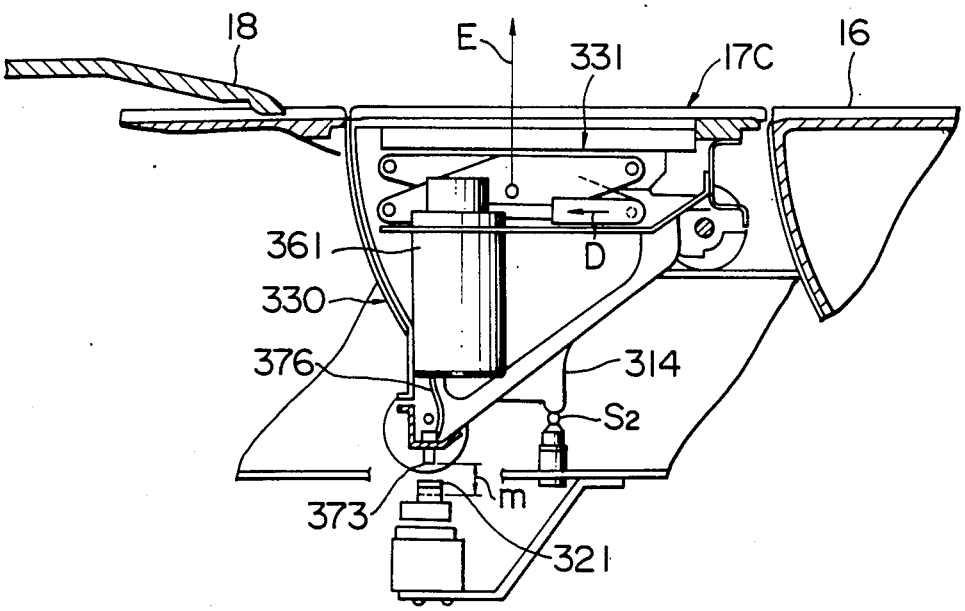
FIG. 11 is a cross-sectional view showing a primary part of still another embodiment of the invention.
Figure 12:
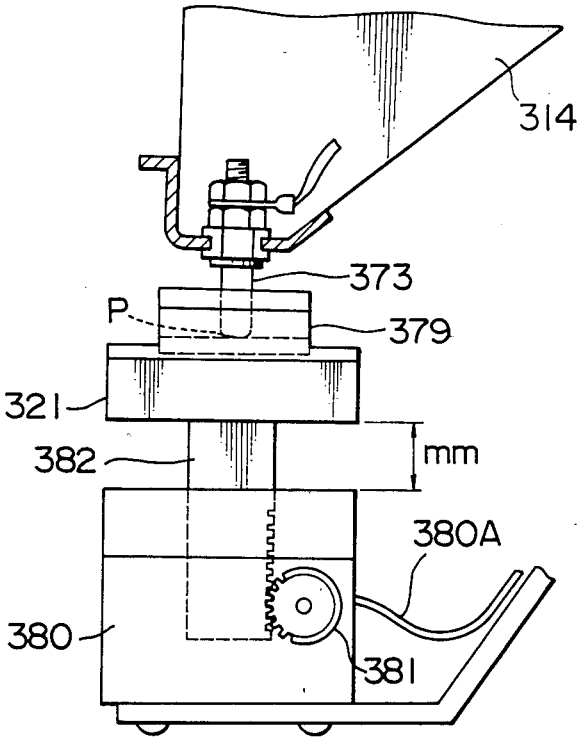
FIG. 12 is an enlarged cross-sectional view showing the primary part shown in FIG. 11.

Furthermore, on a side of the special step 17C, there are provided a projection 314 and a stop switch $S_2$ which contacts with the projection 314 for stopping the special step 17C in the vicinity of the entrance 18 as shown in FIG. 11. Incidentally, the electric power supply means 321 is composed of a contact 379 substantially in the form of a U-shape as shown in FIG. 12 and a motor 380 for upwardly moving the contact 379 when the motor 380 is subjected to an electric instruction signal. For example, the raising mechanism includes a pinion 381 and a rack 382. Such raising mechanisms are provided for both the entrance 18 and exit 19. In this case, when the special step 17C is stopped at a desired position by means of the stop switch $S_2$, the motor 380 is rotated to bring the contact 379 into contact with the supply means 373, so that an electric power supplied through the power source line 380A is fed to the tread surface widening mechanism 330 to form an effective tread surface needed for the loading the wheel chair.

The operational order of the foregoing mechanisms and components will be described. The following series steps are effected: depression of the stop switch $S_1$, actuation of the stop switch $S_2$, stop of the special staircase step 17C at a predetermined position, lift of the supply means 321, contact with the receiving means 373, actuation of the tread surface widening mechanism 330, expansion of the tread surface, lowering the supply means 321, loading the wheel chair, operation of the actuation switch $K_1$, and movement of the special staircase step. Also, when the special step 17C reaches a position just before the exit 19, the stop switch $S_3$ is actuated to stop the step 17C. When the step 17C is stopped, the following series steps are effected: unloading the wheel chair, lifting the supply means 321, contact with the receiving means 373, decreasing the tread surface (i.e., reverse operation of the tread surface widening mechanism 330), lowering the supply means 321 and returning back to the normal operation.

The above-described series operations are controlled by electric circuit means whose details have been omitted but it is apparent for those skilled in the art to use a variety of electric means therefor. In particular, emergency stop switches $K_2$, $K_3$ and $K_4$ are arranged at predetermined positions of the handrails 12.

The above-described construction is applicable to the upward and downward operations of the escalator. In particular, since the electric source power for moving the special step 17C is supplied only at the entrance 18 or exit 19, there is a little fear of troubles in the electric system and the minimum possible electric wire system may be obtained.

Also, although, in the foregoing embodiment, the supply means 321 is moved to the receiving means 373 to effect the electric connection therebetween, it is possible to move receiving means 373 to the supply means 321 for the electric connection by means of, for example, suitable cam means.

Incidentally, although the foregoing description has been made only as to the loading of the wheel chair on the special step, it is understood that the invention may be applied in the same manner to the loading and transportation of heavy articles.

We claim:

1. An escalator having a body frame and a plurality of staircase steps connected in an endless manner and supported by said body frame, wherein at least one of said plurality of staircase steps is made for a wheel chair loading staircase step, said wheel chair loading staircase step comprising: a main tread board movable upwardly; a sub-tread board supported by said main tread board; means for lifting said main tread board and said sub-tread board; electric drive means for driving said lifting means; and means for automatically moving said sub-tread board relative to said main tread board to provide a combined planar tread surface of said wheel chair loading staircase step in accordance with an upward movement when said lifting means is driven by said drive means to lift said main tread board and said sub-tread board upwardly.

2. The escalator according to claim 1, wherein said sub-tread board is pivotable between a folded position on said main tread board and an open position parallel to said main tread board.

3. The escalator according to claim 2, wherein said lifting means and said means for automatically moving are composed of link mechanisms cooperated with each other.

4. The escalator according to claim 2, wherein said means for automatically moving includes a gear rotated by a motor and a link mechanism connected to said gear.

5. The escalator according to claim 2, wherein said staircase step includes wheel chair stoppers each of which is selectively projectable, said wheel chair stoppers being provided on said main tread board and said sub-tread board.

6. The escalator according to claim 2, further comprising electric power supply means for supplying an electric power to said drive means exclusively as desired.

7. The escalator according to claim 6, wherein said supply means includes a contactor provided on a side of said body frame and an associated contactor provided on a side of said staircase step, said contactor on the body frame side being moved toward said associated contactor on the staircase step side as desired.

* * * * *